United States Patent [19]

Foresto

[11] Patent Number: 4,550,669

[45] Date of Patent: Nov. 5, 1985

[54] BURNING APPARATUS WITH MEANS FOR HEATING AND CLEANING POLLUTED PRODUCTS OF COMBUSTION

[76] Inventor: Sam Foresto, 243 Willis Ave., Mineola, N.Y. 11501

[21] Appl. No.: 691,686

[22] Filed: Jan. 15, 1985

Related U.S. Application Data

[63] Continuation-in-part of Ser. No. 541,217, Oct. 12, 1983, abandoned, which is a continuation-in-part of Ser. No. 404,665, Aug. 3, 1982, Pat. No. 4,430,950.

[51] Int. Cl.[4] ..... F23G 5/00

[52] U.S. Cl. ..... 110/245; 122/4 D; 110/315; 110/248; 110/227; 110/208

[58] Field of Search ..... 110/208, 209, 211, 214, 110/224, 227, 235, 245, 252, 315, 248

[56] References Cited

U.S. PATENT DOCUMENTS

| | | | |
|---|---|---|---|
| 4,267,801 | 5/1981 | Robinson | 110/245 |
| 4,273,073 | 6/1981 | Robinson | 122/4 D |
| 4,317,417 | 3/1982 | Foresto | 110/245 |
| 4,338,074 | 7/1982 | Johansson | 122/4 D |
| 4,343,247 | 8/1982 | Chronowski | 122/4 D |
| 4,355,601 | 10/1982 | Hattiangadi | 110/245 |
| 4,416,418 | 11/1983 | Goodstine et al. | 110/245 |
| 4,427,375 | 1/1984 | DiRosa | 110/245 |
| 4,434,723 | 3/1984 | Brecley et al. | 122/4 D |

*Primary Examiner*—Henry C. Yuen

*Attorney, Agent, or Firm*—Nolte, Nolte and Hunter

[57] ABSTRACT

Apparatus for burning material such as fuel, waste material and the like, which when burned produces gases within which pollutants are entrained and for cleaning the gases. The apparatus comprises an incinerator or a furnace having a combustion chamber in which the material is burned and in which tubes, preferably apertured, extend through the burning coke to which solid fuels are reduced and through the flames of an oil burner gun, for example within the confines of the combustion chamber which in such an instance is also a refractory chamber, act to conduct the polluted gases of combustion from the burning material through the same burning material where they are super heated and cleaned.

22 Claims, 14 Drawing Figures

BURNING APPARATUS WITH MEANS FOR HEATING AND CLEANING POLLUTED PRODUCTS OF COMBUSTION

This is a continuation-in-part of co-pending application Ser. No. 541,217, filed Oct. 12, 1983 now abandoned, which was a continuation-in-part of application No. 404,665 filed Aug. 3, 1982, now U.S. pat. No. 4,430,950.

BACKGROUND OF THE INVENTION

The present invention relates to incinerators in general and, specifically, relates to improved incinerators whereby the waste gases are raised to a high temperature in order to eliminate particules of pollutants and noxious gases from the incinerator exhaust gases.

In known incinerators the waste material is dumped or deposited on grates or the like and consumed by burning. The exhaust gases from the burning waste material are permitted to go up the chimney or flue of the incinerator. An ash pit or the like is arranged beneath the grate to catch the ashes.

In known incinerators, the waste materials are substantially consumed in the burning process, and the waste gases permitted to escape up the flue. Such waste gases, therefore, include a relatively large amount of particulate pollutants, which may be reduced to a certain extent by precipitators or the like, and also a relatively large amount of gasified pollutants that are generally noxious. These noxious gases may be reduced to a certain extent by the use of scrubbers or the like. Nevertheless, the overwhelming majority of incinerator installations contain neither a particle precipitator nor a gas scrubber.

SUMMARY OF THE INVENTION

The present invention provides an improved incinerator that both reduces the particle pollutants in the incinerator waste gases and also reduces noxious gasified pollutants in such waste gases. The present invention can be added to an existing incinerator or can be included in the incinerator design when building a new incinerator.

The invention teaches the secondary heating of the waste gases by means of an additional burning station or stations. The additional or secondary burning stations are constructed in such a way that the waste materials burn in a downward direction, with the waste gases from the preceding burning stations being passed through the heated ash and coke in a subsequent burning station, thereby raising the temperature of the original waste gases. When a plurality of heating sections is employed, the initial heating section has the waste gases and waste materials burning conventionally in an upwards orientation, whereas in the secondary station, the waste materials burn in a downward direction and, thus, the waste gases pass downwardly therethrough. Because the flames and gases produced in this secondary station are reversed, they pass down through the heated ashes and coals and, thus, tend to be self-cleaning. The present invention teaches the use of perforated tubes arranged on the grid holding the waste material to provide oxygen, as contained in the air, to the middle portions or center of the layer of waste materials being combusted.

The present invention also teaches that the incinerator and secondary burning stations can be used in conjunction with a heat exchanger to utilize some of the heat being generated by the burning of the waste material.

Following the teachings of the present invention it is possible to raise the temperature of the waste gases to between 2300°–3000° F. This is sufficient to heat the exhaust gases to a point which will burn off the noxious gasified pollutants. The present invention also teaches that in order to so reduce the undesirable pollutants, these high temperatures should be maintained for as long as possible. Thus, by passing the exhaust gases back through additional burning stations it is possible to maintain these waste gases at the elevated temperature for a much longer period than heretofor possible.

The concept of heating the waste gases by passing them through tubes which extend through the burning coke, which is what the burning waste material becomes, has been found to be efficiently utilized by the provision of a single grate, for example, in a combustion chamber from which the waste gases are directed through conduits back through the tubes which pass through the burning bed of waste material and from thence are directed to the atmosphere. Furthermore, it has been determined that the heated waste gases may also be directed into further tubes overlying the bed of burning waste material. These further tubes act as a catch for the introduction of waste material via separate accesses. In this latter instance, the upper tubes, heated by the heated gases and by the fire below, act to dry and partially burn waste material before it falls to the burning bed of coke below. In this construction, a grate may be provided to underlie the upper tubes to form yet another bed of burning waste material in the same chamber and which, when burned sufficiently, may be made to fall through the upper grate onto the bed of burning material below. In such a construction, the waste gases are passed through two beds of burning waste material.

It is the basic object of the invention to pass waste gases from burning waste material or from any fuel through the bed of the waste material or fuel being burned to thus raise the temperature of the waste gases.

It is an object of the present invention to provide incinerator apparatus to reduce particulate pollutants in incinerator waste gases by providing additional burning stations for waste materials and passing the waste gases through additional, downwardly burning waste material that has formed a layer of heated ash and coke.

It is another object of the present invention to reduce noxious gasified pollutants in incinerator waste gases by passing the gases through additional burning stations wherein waste materials are being combusted and which have a layer of heated ash and coke.

It is a further object of the present invention to reduce pollutants in incinerator waste gases by providing additional burning stations and wherein the waste gases are passed in an upward direction through the heated ash and coke of one waste material burning section and in a downward direction through the heated ash and coke of a subsequent waste material burning station.

It is an object of the invention to provide tubes extending through the burning material in a combustion chamber and through which the polluted gases from burning material in that chamber are conducted.

It is still a further object of the present invention to provide air-injection tubes for use in an incinerator to provide air as well as a conduit for the smoke and waste gases to the center layer of burning material and to thus act as flues in directing the air and waste gases in the draft direction.

The manner in which these and other objects are accomplished by the present invention will be set forth in the following detailed description.

DETAILED DESCRIPTION OF THE INVENTION

Figure 1:
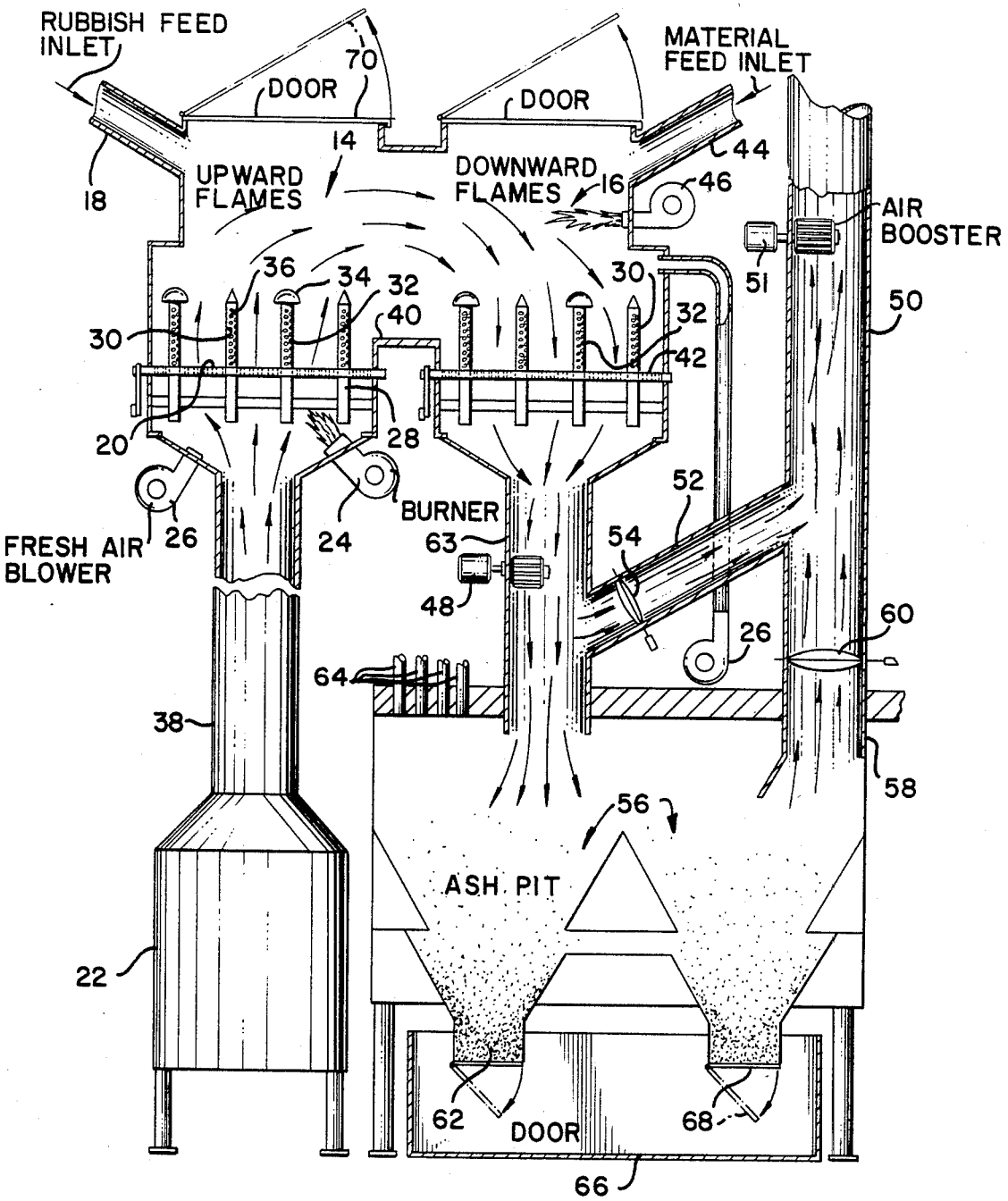
FIG. 1 is a schematic representation of a side elevation of an incinerator employing the present invention.

FIG. 1 shows the present invention having a single enclosure involving two burning stations and installed on an existing incinerator or on any other system that produces waste gases from burning. That is, the waste gas and particulate cleaning apparatus taught in the present invention comprises two separate burning locations, 14 and 16. In the embodiment of FIG. 1, a first rubbish feed inlet 18 is arranged at the top of the incinerator and the rubbish and waste material is fed in and falls downwardly onto a grate 20. Drying and initial combustion of the rubbish on the grate 20 is accomplished by an external source of heat 22, which can be a fire box burning coal, wood, oil, or any fuel sufficient to raise the temperature of the rubbish laying on the grate 20 to a temperature high enough to commence burning. Fire box 22 can be any existing source that produces noxious waste gases. Such burning of the rubbish or waste material is aided by a burner 24 that can be a gas jet or the like, and by a fresh air blower 26 that provides additional oxygen to air combustion of the waste material lying on the grate 20. Because the rubbish and waste material will be fed to the initial burning station faster than it can be consumed by the fire, layers of this waste material will build up on the grate 20. In order to provide oxygen to the interior of this build-up, a number of perforated pipes or air-injection tubes are provided. There are two kinds of these air-injection tubes, those tubes 30 with closed ends, and those tubes 32 with open ends covered with metal domes or shields 34. Each of these tubes has a plurality of holes 36 formed in the wall thereof. In tube 34 the upper end is open but is protected from being clogged by falling waste material by a cap or dome shaped metal shield 32 that is affixed to the tube 28 and protects the open end of the tube. These tubes 30, 32 will be shown in more detail hereinbelow.

In operation of the system described so far, the heat from the fire box 22 passes upward through a flue 38, through the grate 20 and dries and ignites the waste material which has been deposited thereon. Air to promote combustion is fed to the layers of burning waste material on grate 20 by the tubes 30, 32 and by the fresh air blower 26. In this fashion, the rubbish and other waste materials on the grate 20 will be substantially consumed. This then leaves the situation, as in the past, wherein the gases from this burning waste material contain noxious gasified pollutants and other particulate pollutants. At this point conventional incinerators vent the waste gases out a flue and up the chimney to the atmosphere.

The present invention not only provides an additional, downwardly directed burning station, but also improves the degree of combustion of the waste materials at this initial burning station. To encourage the burning of the rubbish and the like deposited upon the grate system 20 the burner 24 and the fresh air booster 26 are provided, the booster 26 and the air-injection tubes 30, 32 aiding the introduction of oxygen into the mass of the burning medium. If the burning medium should pack too densely then, absent the air-injection tubes, air will be unable to penetrate it, and it will be impossible to create a suitable combustion within the internal volume of the densely packed medium. It is the purpose of the tubes 30, 32 to aid in the introduction of oxygen into the mass of the burning medium. If the burning medium should pack too densely then, absent the air-injection tubes, air will be unable to penetrate it, and it will be impossible to create a suitable combustion within the internal volume of the densely packed medium. It is the purpose of the tubes 30, 32 to aid in the introduction of oxygen into the center of the mass of the burning medium. The perforations 36 along the length of these tubes serve to permit the air to enter the center of the medium. The present invention takes into account the possibility that upper ends of the tubes may reside beneath the burning waste material. The specific structure of these air-injection tubes will be set forth in detail hereinbelow.

The present invention teaches the filtering and scrubbing of the waste gases from the burning process by passing the gases through a layer of heated ash and coke formed by burning waste material in a downwardly direction, i.e., the flames are forced in the direction from the top of the layer to the bottom. This is accomplished by providing a second burning station 16 adjacent the first burning station 14, and separated only by a low wall or divider 40 so that the flames in the first burning station can readily leap across the wall. This second burning station 16 also employs a grate 42 and the inventive air-injection tubes 30, 32 to promote complete combustion of the waste materials that are piled onto the grate 42 after having been fed in through feed inlet 44. A burner 46 is provided to aid the burning of the waste material and the like which has been fed through the additional rubbish feed inlet 44. In the present invention it is important that the direction of flow of the waste gases and of the flames in the second burning station 16 be in a downward direction through the grate 42, while the direction of flow of the flames and gases in the first section 14 is upwards. This is important in order to encourage an increase in the burning temperature of the medium in both sections, as well as throughout the mass of the medium. As the flames and gases rise through the burning medium in the first burning station 14, the flame and burning of the medium therein is encouraged from the bottom injection tubes 30, 32 and the blower 26. As the gases then flow from the first section 14 across the separator 40 to the second burning station 16, the heat and flames of the burning medium of the first burning station 14, are transferred to and jump to the top of the burning medium residing on the second grate assembly 42 of the second burning station 16. The downward flow in the second burning station is encouraged by a fresh air blower 47.

Because the direction of the flow of the flames and waste gases in the second station 16 is in a downwardly direction, there is a tendency for the burning medium of the second station to burn more rapidly at the lower portions than at the upper. To encourage a more even burning of the medium residing on the grate assembly 42 in the second burning station 38 the blower 47 and the air-injection tubes 30, 32 serve to distribute oxygen to the top surface of the burning medium and also to promote combustion. The flames jumping over from the first burning station 16 combine with the oxygen being admitted from the air-injection tubes 30, 32 to create a fire across the top of the burning medium residing on grate 42.

The air being injected or permeating the interior mass of the burning medium on the grate 42 in the second burning station 16 by passing outwardly therefrom through holes 36 in the air-injection tubes encourages the burning of the interior of the medium in the second burning station 16. Since the gases from the first burning station 14 must pass through the hot ashes and coke from the medium burning in the second burning station 38, the temperature of the exhaust gases from the first station is raised substantially. This layer of heated coke is frequently between three and five feet in depth. Also, the time during which these gases are in contact with the burning medium and the ashes and coke thereof is greatly increased, aiding in the filtering and scrubbing of pollutants from the waste gases.

Thus, what takes place is that the burning medium in the second section 16 is subjected to a fire at the middle caused by the injection of air, at the top from the burner 46 and the flames leaping over from the first burning station 14, and at the bottom from the action of the draft of the entire assembly. The waste gases exiting from the lower portion of the second burning station 16 are in a downward direction and will strive to be exhausted by a flue or chimney. The downward flow of these gases is encouraged and increased by the use of the additional air booster or blower 47. The waste gases flowing downwardly and outwardly from the second burning station also encourages the burning of the bottom surface of this medium. This medium at the bottom then burns upwardly toward the top, and the top burns downwardly toward the bottom, while all the time the middle is being encouraged in its combustion by the air which is being injected therein by the air-injection tubes 30, 32.

As the waste gases flow from the first burning station 14 through the second burning station 16, the second section will have a substantial layer (up to 3–5 feet) of burned coke of extremely high temperature resulting from the burning of the medium thereat, as encouraged not only by the draft of the system but also from the flames from the first section. This burned coke layer residing on the grate 42 forms a bed that functions as a filter to purify waste gases that must flow therethrough in a downward direction, including the waste gases produced by the burning in the second section. As the waste gases flow downwardly through the coke of the burned medium, they are filtered mechanically by the porous coke and are subjected to intense heat by the superheated coke to burn off pollutants that are normally entrained in the gases. Hence, the waste gases passing through the burned coke of the medium are cleaned and become substantially free of noxious pollutants.

One of the novel features of the present invention resides in the ability to produce a filtering bed of coke of burned medium of extremely high temperature through which waste gases must flow in a downwardly direction before they can be exhausted into the atmosphere and it is noted that this bed of hot coke can be formed by burning coal, wood, or charcoal and it is not necessary to burn refuse or waste material. After the waste gases are cleansed by the filtering bed of coke in the second burning station 16 the gases are then diverted upwardly through the chimney 50 into the atmosphere. An auxiliary air booster or fan 51 can be included in chimney 50 to aid the draft of the incinerator and to increase the draw; i.e., the flue action of the chimney 50. The present invention provides two paths through which the exhaust gases can be connected to the chimney 50. The first path is through an exhaust pipe 52 that has a flapper valve 54 to control the exit of the gases therethrough. Alternately, the gases can be passed through a heat exchanger section, in which case the gases enter what may be termed an ash chamber 56 and then exit through an exhaust tube 58 connected to the chimney 50 by a flapper valve 60. In either event, the particulate in the exhaust gases and the ashes from the combustion in the combustion section 36 will fall through the chamber 56 and be suitably distributed into ash pits represented typically at 62. In the event that the heat exchanger section is to be employed, then flapper valve 54 will be closed and flapper valve 60 will be opened, thereby causing the exhaust gases to flow down exit pipe 63 into the ash chamber 56, through the exhaust pipe 58, past flapper valve 60, and out chimney 50. In this fashion the chamber 56 is heated and is available for use with a suitable heat exchanger, as represented schematically by the heat exchanger tubes 64.

Once the system is in operation it will be necessary to remove ashes following the combustion, and this is accomplished by the positioning of a suitable container 66 beneath the ash pits 62. Communication between the ash pits 62 and the container 66 can be accomplished by doors, shown typically at 68. Similarly, it may be required to perform certain maintenance functions on the burning stations themselves, in which case doors, shown typically at 70, are provided on the top of the incinerator for access by maintenance personnel.

Figure 2:
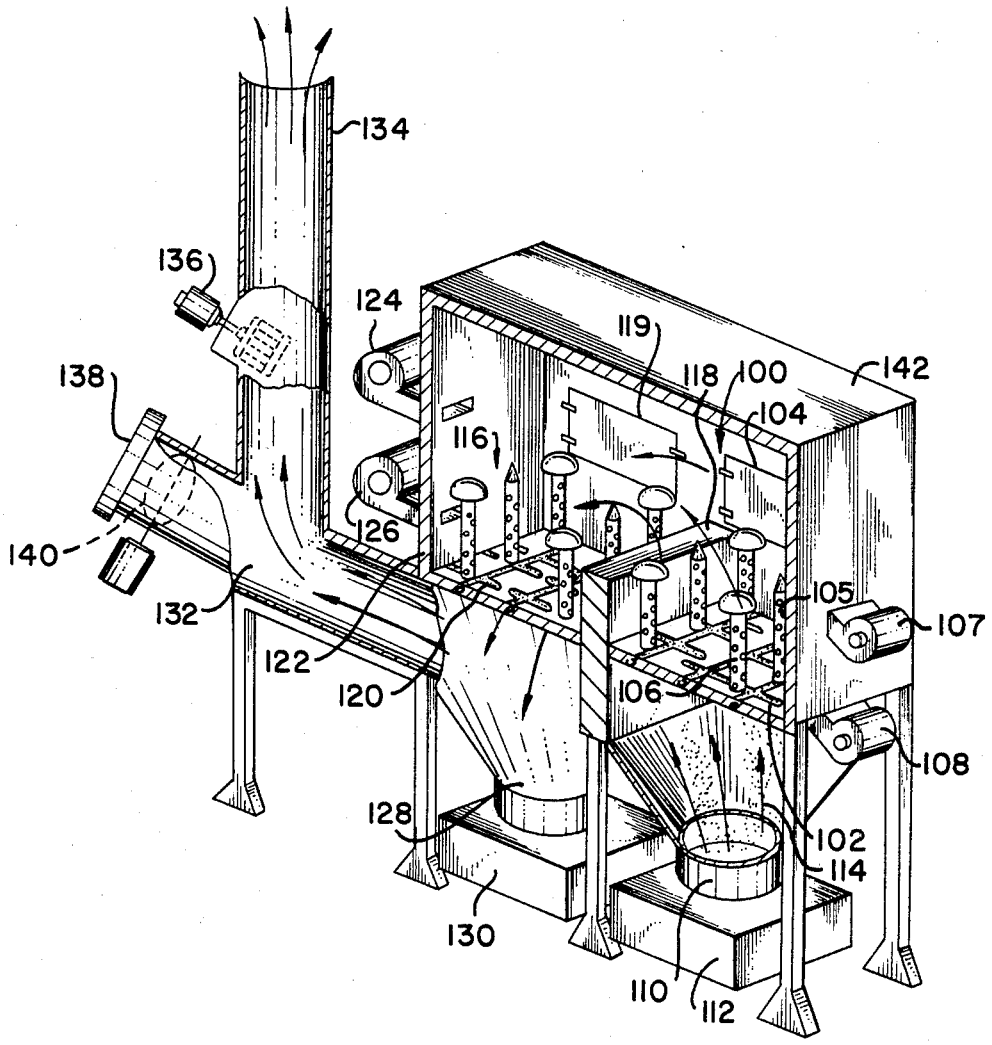
FIG. 2 is a perspective view of an incinerator in partial schematic form, showing the present invention.

FIG. 2 shows another embodiment of the present invention similar to that of FIG. 1. Specifically, a smaller, self-contained incinerator having a single combustion chamber with two burning stages is provided, wherein the second stage involves a downward flow of flames and gases through a layer of superheated coke and ash in order to filter and scrub the pollutants from the exhaust gases. Specifically, a first burning stage, shown generally at 100, is provided and employs a grate 102 to retain the rubbish and waste material to be combusted and which is fed in through a door 104. The air-injection tubes 105, 106 are employed to provide air to the middle and top of the layer of burning rubbish and ash which is supported by the grate 102. A burner 107 is provided to start the fire and to raise the temperature initially to combust the materials, and a blower 108 is provided to supply fresh air to aid the combustion of the burning refuse. An ash pit, represented by the funnel-like arrangement 110 and a suitable container 112 are located beneath the grate 102. The arrows 114 represent the upward flow of air through the grate 102 and indicate the general direction of burning of the refuse located in the first burning stage 100, i.e., from bottom to top.

The second burning state 116 is separated by a low wall or divider 118 from the first burning stage 100 and is substantially identical to the first stage, i.e., it employs a door 119 through which the materials to be burned are fed, a grate 120 upon which the waste materials initially are supported, and the air-injection tubes 105, 106 for promoting combustion throughout the layer of burning material. The divider 118 is sufficiently low so as to permit the flames from the first stage to leap over onto the material in the second stage. A blower 124 injects fresh air to promote burning and a booster burner 126 is provided to initiate the combustion of the materials fed in through door 119. The second stage 116 is provided with an ash pit 128 and a container 130 to receive the ashes. The outlet of the incinerator includes an exhaust conduit or flue 132 which is connected to the main chimney or flue 134. The chimney 134 can employ a heat exchanger inserted therein to utilize the residual heat which normally would be lost up the chimney. A booster blower 136 is employed to aid drawing the gases up the chimney 134, and an auxilliary outlet 138 is provided in connection with an automatic flapper valve chimney 134, and an auxilliary outlet 138 is provided in connection with an automatic flapper valve 140. The auxiliary outlet 138 is for future use for connection to a heat exchanger to extract heat from the exhaust gases. Similarly, the entire chamber shown genrally at 142, surrounding both burning stages can be provided with double walls or the like so that the entire chamber can also be utilized in a heat exchanger to perform work from the heat given off by the burning of the materials.

In operation of the embodiment of FIG. 2, again the fire in the first burning stage 100 burns in an upward direction and the flames and waste gases are forced by the blowers and natural convections to flow upward and over onto the top of the burning materials in the adjacent combustion chamber 116, thereby causing the materials therein to burn in a downwardly direction so that the fire being supported on grate 120 burns downwardly and, thus, the exhaust gases from the first stage 100 are caused to pass through the super-heated coke and ashes in the second stage 116 and are permitted to exit through the chimney only after having been raised to a higher temperature then normally possible and maintained at such higher temperature for a longer period of time then possible with a single burning stage. The second stages will tend to be self-cleaning, since the waste gases produced thereat will flow through the coke before being exhausted up the chimney.

Figure 3:
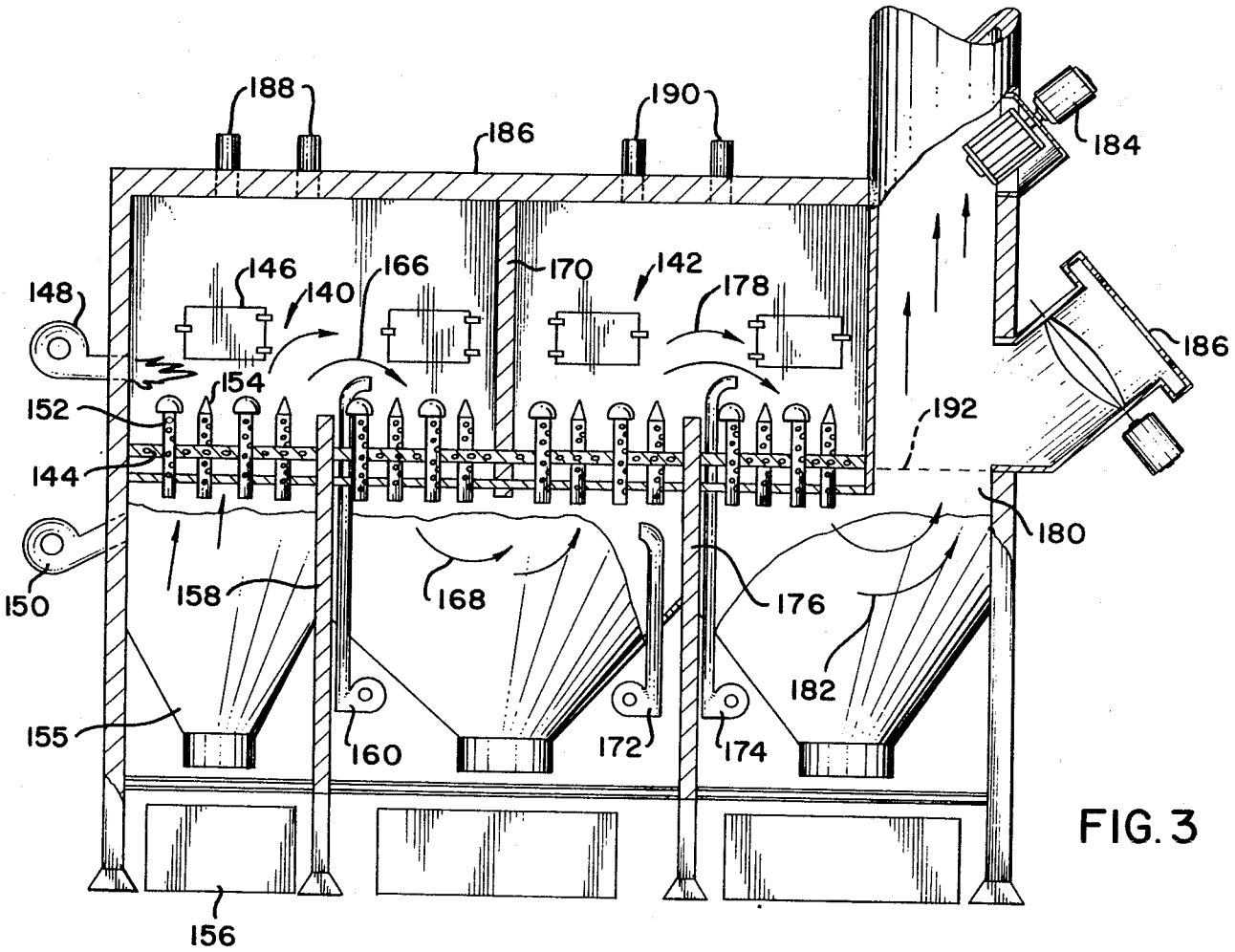
FIG. 3 is a schematic representation of a side elevation of an incinerator having a plurality of burning stations, as taught by the present invention.

Referring to FIG. 3, another embodiment of the present invention involving a multiple stage incinerator is disclosed, wherein the exhaust gases are repeatedly passed in a downward direction through high-temperature burning material and coke. The embodiment of FIG. 3 involves two separate and distinct burning chambers 140 and 142. Each chamber possesses the upward and downward burning modes so that the waste gases from the first burning station pass downward, upward, and downward again before finally being exhausted through the chimney. Thus, the exhaust gases are exposed to extremely high temperatures and for a relatively long period of time. As in the above-described embodiments, the first chamber 140 employes a grid work arrangement 144 upon which rubbish and the like can be burned after it has been fed into the chamber through door 146. The burning in the first section of chamber 140 is initiated by a burner 143 and combustion is promoted by the injection of fresh air through a fresh-air booster blower 150. The blower 150 acts in conjunction with air-injection tubes 152, 154 to promote combustion throughout the relatively thick layer of burning material and red-hot coke. The ashes and the like following combustion in this portion of the chamber may fall down into a suitable ash pit 155 for ultimate removal therefrom into a container 156. The sections of the first burning chamber 140 are separated by a short wall or separator 158 and the second burning station of chamber 140 is substantially structurally identical to the first. The refuse and the like is placed on a grate for burning, however, in this burning station such burning is accomplished in a top to bottom or downward direction, based upon the air and gas flow within the chamber 140. A booster pump 160 is provided to add fresh air to insure that combustion is thorough. The waste gases and flames from the first burning station will go in the direction shown generally by arrows 166 and the waste material will burn in a generally downward direction, from top to bottom. The waste gases from the second burning station of chamber 140 will go in the direction as shown by arrows 168 and, thus, enter second chamber 142 from the bottom. Chamber 142 is separated from chamber 140 by a suitable fire wall 170. Combustion chamber 142 is substantially identical to chamber 140 and employs fresh-air blowers 172 and 174 to provide additional air to aid combustion.

Of principal interest is the path the exhaust gases are forced to follow. That is, the flames and gases in the first burning station of chamber 142 are in an upward direction, as indicated by arrows 168. The gases and flames must pass over a short separating wall 176 and into the second burning station of chamber 142, as indicated by arrows 178. The burning and gas flow are in a downward direction in this section of chamber 142 and, finally, the gases are caused to flow down and out into the chimney 180, as shown by arrows 182. The chimney 180 can employ a booster pump 184 to aid the drawing of gases up the flue and also an outlet 184 for future use in conjunction with a heat exchanger.

With respect to a heat exchanger, the entire structure 186 surrounding or forming the shell of the incinerator may function as a heat exchanger, as represented by heat exchanger pipes 188 and 190. Thus, in the embodiment of FIG. 3 employing the multiple burning stages, the gases from the first burning station flow upwardly and cross over, as shown by arrows 166, into the second section which burns in a downwardly direction and the gases therefrom flow upwardly through the first section of a separate combustion chamber 142. The gases from this first section cross over, as shown by arrows 178, and down through the second section and ultimately up the chimney, as shown by arrows 182. These multiple passes will not only elevate the temperature of the exhaust gases by repeated contact with the super-heated coke and ashes produced by the burning refuse, but also such elevated temperatures can be held for a substantial length of time due to these multiple passes. As in the embodiments it is the passing of the waste gases through the beds of very hot coke that is important and the coke beds may be formed by having any suitable material, e.g., coal, charcoal, rubbish, etc.

To provide additional filtering a fine mesh grate, shown by dashed lines 192, can be added. Alternatively, a final burning station could be also located there. This burning station would burn in an upward direction, so that prior to being exhausted the waste gases would pass through an upwardly burning mass.

Figure 4:
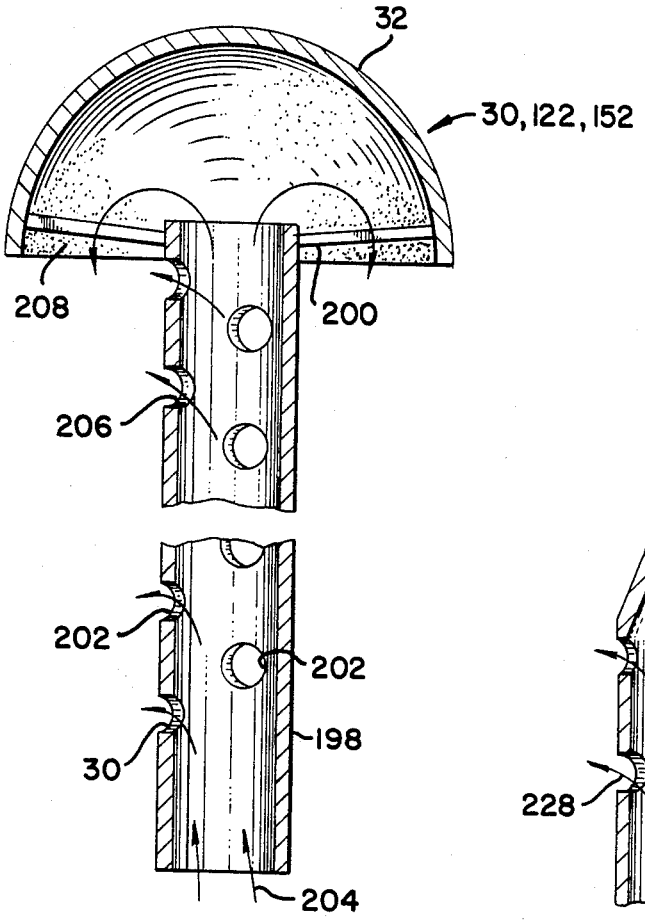
FIG. 4 is a cross-sectional view of a perforated air-injection tube having a shield element affixed thereto.

FIG. 4 shows a detail of one of the air-injection tubes in cross section. This air-injection tube corresponds to the one having a cap or shield, as shown at 30, 122, 154 in the preceding figures. These tubes may be formed of a length of suitably heavy gauge pipe or tubing 198, and the cap or shield 32 can be attached to the main tube by three equally spaced supports or ribs, shown typically at 200. The perforations, shown typically at 202, in the tube can be equally spaced and should be of suitable size so as not to be plugged easily and to provide adequate air flow. The air flow in the air-injection tube assembly 30 proceeds upwardly through the bottom of the tube 198, as indicated by arrows 204 and then exits both through the apertures or holes 202, as shown by arrows 206, and out of the top of the tube, as shown by arrows 208.

Figure 5:
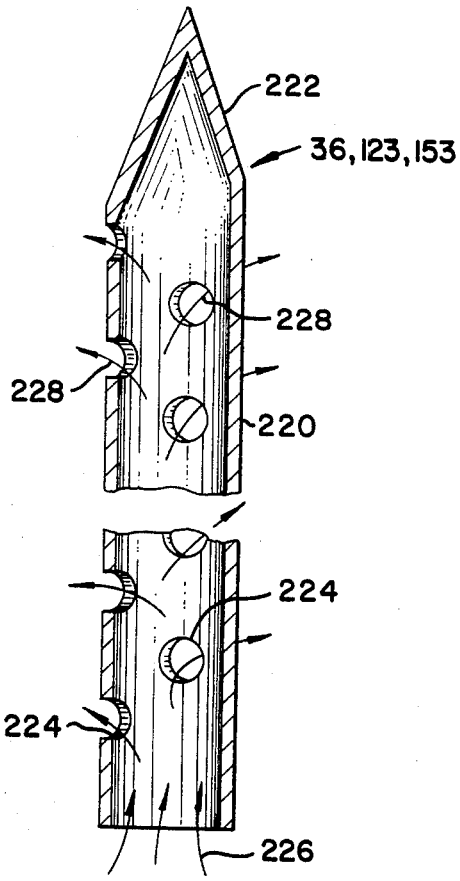
FIG. 5 is a cross-sectional view of a perforated air-injection tube having a closed, pointed upper end.

FIG. 5 shows the other style of air-injection tube taught in the present invention. This is the pointed tube shown at 36, 123, 154 in the preceding figures. In this embodiment, a suitably heavy gauge pipe or tube 220 is provided with a pointed end 222, which can be integrally formed or welded onto the tube. As in the shielded tube of FIG. 4, a number of apertures, shown typically at 224, are formed in the wall of the tube 220. Air flowing into the bottom of the tube, as shown by arrows 226, can exit only through the apertures 224, as shown by arrows 228. The shield on the air-injection tube of FIG. 4 is provided to prevent debris and rubbish from entering and clogging the pipe, however, if enough rubbish or ashes are present to cover the air-injection tube and occlude the apertures then all of the air will be forced to exit from the top of the tube, i.e., from beneath the shield. This will defeat the purpose of injection air into the center of the burning mass. To take care of that situation, the embodiment of FIG. 5 is provided for use in combination with the shielded-end tubes. Because of the closed pointed end 222, all air entering the tube 36 must exit through the apertures 224, thereby causing the apertures 224 to be self-clearing, so that even if the rubbish or ash is piled over the top of the air-injection tube, air will still be injected into the center of the layer of burning material.

Figure 6:
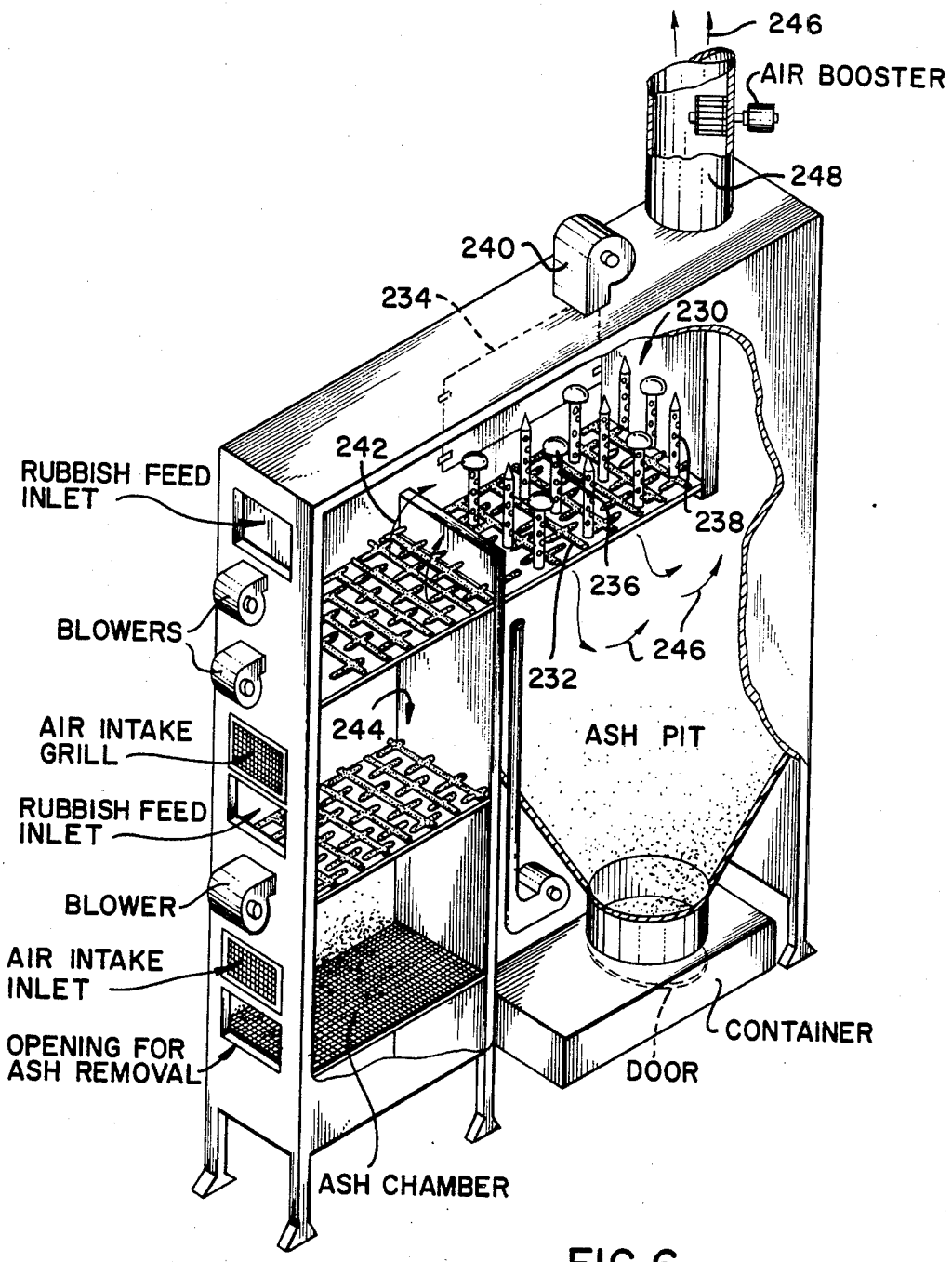
FIG. 6 is a perspective view, in partial schematic form, of another embodiment showing a multi-level incinerator adapted to practice the present invention.

Referring now to FIG. 6, still another embodiment of the present invention is shown. In this embodiment, an incinerator has a number of vertically arranged burning stations. The burning stations are arranged one above the other instead of sequentially in a horizontal plane, as in the previously described embodiments. In this embodiment, the present invention provides an additional stage wherein rubbish is burned between the top or uppermost stage of the incinerator and the exit path up the flue or chimney. The additional stage, shown generally at 230, employs a grate 232 for supporting the rubbish and waste materials to be burned that have been thrown into the chamber through inlet door 234. The air injection tubes 236, 238 of the previous embodiment are also employed and as in all embodiments act as flues in directing air and most gases in the direction of the draft of the incinerator. An additional blower 240 to aid the burning of these materials and generally to cause the burning to be in a downward direction is arranged at the top or on the roof of the incinerator.

The operation of this embodiment is such that the burning of the waste material takes place in the vertical chambers and the flames and exhaust gases from this burning are caused to pass down onto the top of the waste materials that has been placed in the burning station 230 provided by the present invention, as shown by arrows 242. The additional stage 230 and the adjacent existing burning station 244 are separated only by a low wall over which the flames may readily pass to ignite and burn the waste materials or other fuel on grating 232. The specific construction of the burning chamber in relation to the flue causes the materials in the chamber 230 to burn in a downward direction, thereby forcing the exhaust gases to flow in the direction shown typically by arrows 246, whereupon the exhaust gases flow upwardly out the chimney 248. The draft of the system and the flow up the chimney can be aided by an air booster 250.

As can be appreciated from a reading of the description of the several embodiments of the invention just described, the tubes which pass through the burning waste material act as and in fact are, flues inasmuch as the waste gases are directed through them, albeit also through the waste material, in the direction of the waste gases toward the atmosphere through the chimney. In the following embodiments disclosed in FIGS. 7–9 the tubes of the invention shall be referred to as flue tubes or exhaust flue tubes, as indeed the air-injection tubes of the previously described embodiments may also be called.

Figure 7:
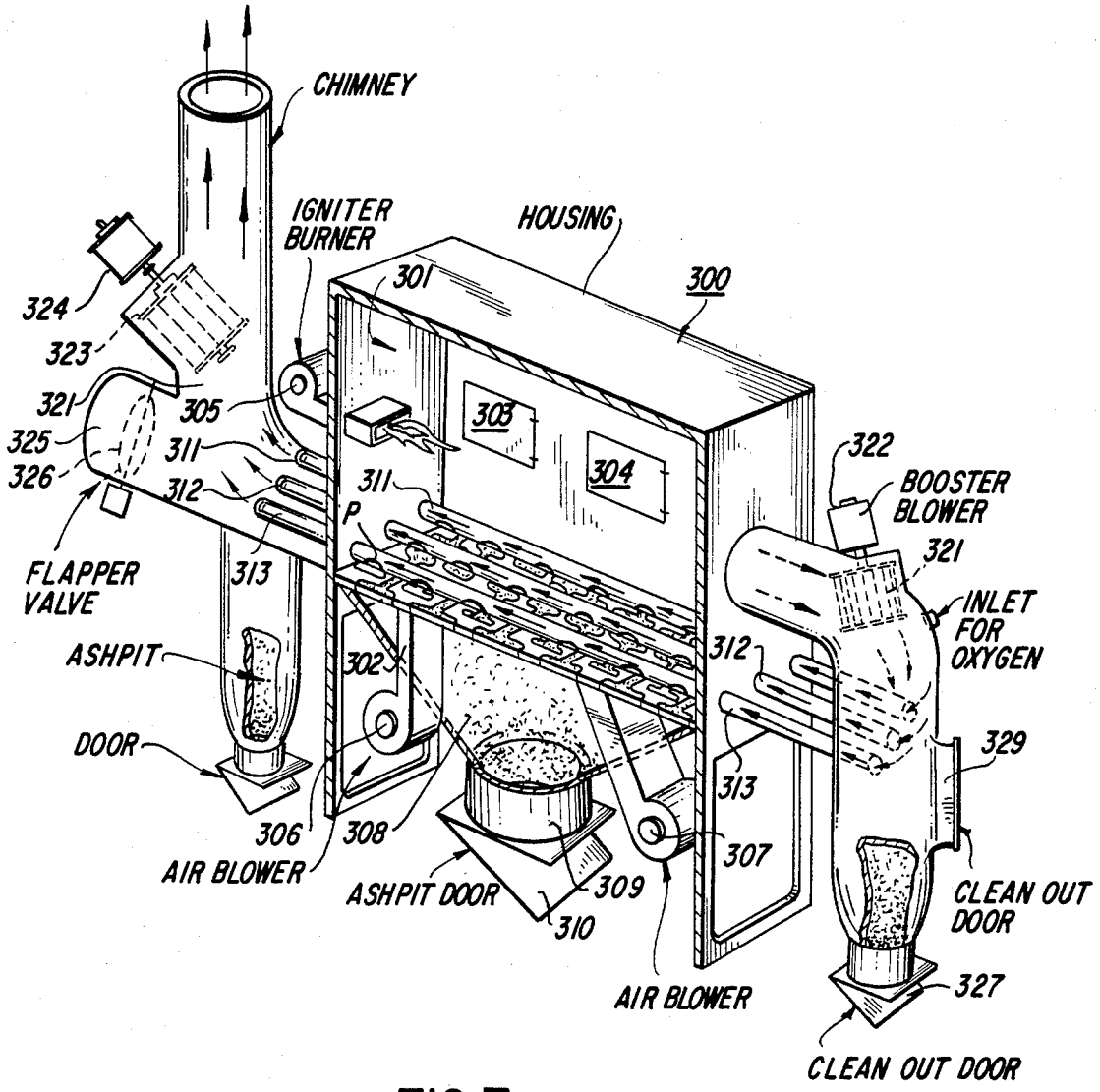
FIG. 7 is a perspective view, in partial schematic form, of yet another embodiment of the invention in which perforated tubes extend through the burning material horizontally and the waste gases from the burning material are directed from the chamber back to and through the burning material through the tubes.

In FIG. 7, a housing 300 for an incinerator or furnace or the like is disclosed forming a combustion chamber 301, the walls of which support a grate 302 below a pair of access doors 303, 304 through which waste material or coal or other fuel is deposited upon the grate. An igniter burner 305 to ignite the material is provided at one end of the combustion chamber and air blowers 306 and 307 extend below the grate at either end thereof and through the ash collector funnel 308 where the ash is collected in the main ash pit 309 which can be emptied via ash pit door 310. The blowers, of course, direct air to beneath the burning waste material or fuel to excite the same.

A plurality of flue tubes 311, 312 and 313 are supported by the ends of the housing and extend parallel with the grate and spaced above the grate. These tubes are perforated at P along their length within the combustion chamber. Not all of the tubes 311, 312 and 313 need be perforated, however. The ends of the tubes 311, 312 and 313 extend outwardly of the ends of the housing into a first conduit 320 at one end of the chamber and into a second conduit 321 at the other end of the chamber.

The upper end of the first conduit 320 is in open communication with the upper portion of the combustion chamber and incorporates a booster blower 321 driven by motor 322 for drawing the hot waste gases and smoke from the burning material from the combustion chamber downwardly to the open ends of the flue tubes 311, 312 and 313 which extend from inside the conduit 320 and through which the waste gases and smoke are forced so as to travel through the tubes to their other ends where the now cleaned waste gases are expelled to the atmosphere through conduit 321. A secondary booster blower 323 driven by motor 324 may be provided for drawing the waste gases through the flue tubes and an extension conduit 325 provided with a flapper valve 326 is provided for conducting the heated waste gases to a heat exhanger, if desirable.

Both the first conduit 320 and second conduit 321 are provided with downward extensions for receiving ash and residue from the smoke and waste gases in the instance of the first conduit and for receiving ash from the cleaned waste gases in the second conduit. These ashes fall into the respective ash pits of the two conduits where there may be withdrawn through clean-out doors as diagramatically shown at 327 and 328 in FIG. 7.

As can be appreciated, the material to be burned is fed through the access doors 303, 304 and burned and the material becomes a bed of burning coke the level of which, of course, is well above the tubes 311, 312 and 313 which are spaced upwardly from the grate so that the bed of burning coke surrounds the tubes. As the smoke and polluted gases, as well as air from blowers 307 and 308 pass through the tubes, first having been drawn through conduit 320, they are heated by the bed of burning coke which surrounds the tubes and because the perforations P help to excite the bed of burning coke internally thereof. The burning material and ash which may be drawn into the tubes through the perforations are expelled into conduit 21 where they drop to the ash bed in that conduit.

In the event ash might clog the tubes, the cleaning of the tubes can be facilitated through the clean-out door 329 provided in conduit 320.

Figure 8:
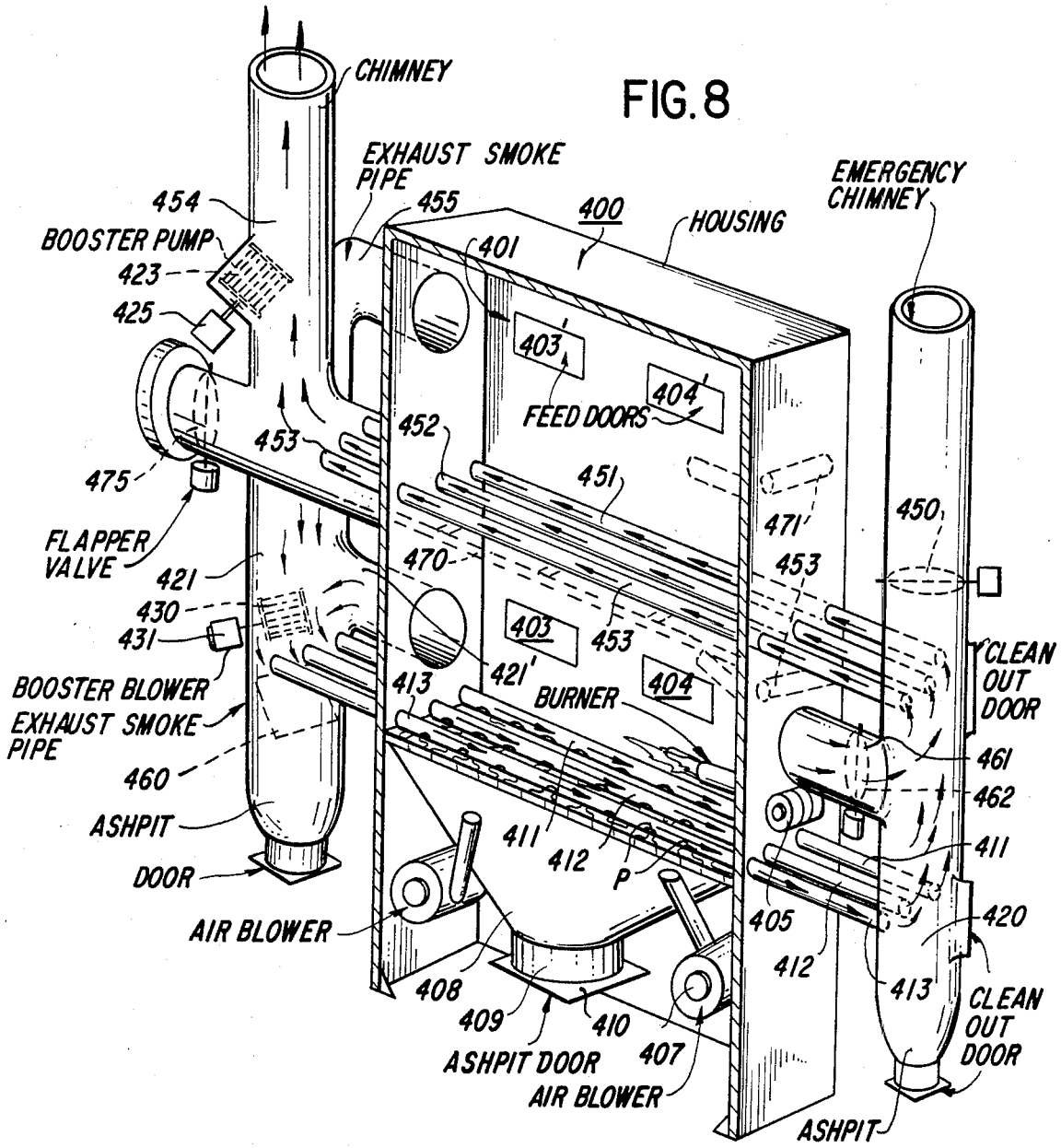
FIG. 8 is a perspective view, in partial schematic form, of still another embodiment of the invention in which the horizontal flue tubes extend through the burning waste material and an another array of tubes carrying the heated waste gases from the first set of tubes is positioned above the lower burning station.

In the construction of FIG. 8 there is also provided a housing 400 for the incinerator or furnace defining the combustion chamber 401 the height of which has been made greater to accommodate, in addition to lower feed or access doors 403 and 404, upper feed or access doors 403' and 404'. The grate 402 is supported by the walls of the housing as in the embodiment of FIG. 7 and as in the previous embodiment igniter burner 405 is supported above the grate for the igniting of the waste material to be burned. Blowers 406 and 407 have their nozzles extending through the funnel shaped ash catch 408 below the grate which directs the ashes from the grate to the ash pit 309 which can be cleaned through ash pit door 409.

As in construction of FIG. 7, flue tubes 411, 412 and 413 apertured as at P extend above the grate and are supported by the housing ends through they extend at one end to terminate with their open ends in conduit 420 and at their other ends in conduit 421.

Conduit 420 which is normally closed by valve 450 communicates with the open ends of the plurality of tubes 451, 452 and 453. These tubes are supported by the sides of the housing 400 and extend intermediate their ends through the combustion chamber at upper stage 401' thereof beneath access doors 403' and 404'. The downstream ends of the tubes 451, 452 and 453 terminate in conduit 454 through which the cleaned exhaust gases are vented to the atmosphere. As in the FIG. 7 construction, the secondary booster blower 423 powered a motor 424 is provided in the chimney conduit 454.

Conduit 455 is a smoke exhaust pipe communicating with the upper stage 401' of the combustion chamber and it communicates directly with conduit 421 which is in fact, a lower extension of exhaust conduit 455.

The FIG. 8 construction contemplates the burning of waste material such as garbage and in which, as in the prior construction, as described herein, is burned on grate 402 to form a bed of burning coke supported by the grate and through which the apertured flue tubes 411, 412 and 413 extend.

Garbage which most frequently is wet can then be fed through access doors 403, 404 where larger waste materials will reside for a time on the flue pipes 451, 452 and 453 which are not apertured.

The smoke and gases from the bed of burning coke on grate 402 are drawn through exhaust conduit 421' to conduit 421 via the action of blower 430 powered by motor 431 which forces the smoke and polluted waste gases through flue tubes 411, 412 and 413 where the gases are cleaned by the extremely high temperature of the burning coke surrounding the tubes. Furthermore, the temperature of the gases is raised considerably.

These hot gases are directed via the flue action of chimney 454 and by blower 430 to conduit 420 where they pass through the open ends of upper tubes 451, 452 and 453 and heat those tubes prior to their exhaust through chimney conduit 454. Booster blower 423 assists in directing the hot gases upward through the chimney conduit.

The hot flue pipes 451, 452 and 453 as can be seen in FIG. 8, are utilized to catch large waste materials deposited on them through doors 403' and 404' and in instances where the waste material is wet, for instance large quantities of garbage and debris, the heated flue pipes 451, 452 and 453 act to dry out the waste material as it is being burned by action of the flames from the burning material on grate 402. This debris when dried and initially burned, will fall through the spaces between the flue tubes 451, 452 and 453 onto the burning material on grate 402 where it will then become a part of the burning bed of coke.

As can be seen in FIG. 8, the smoke and gases from the waste material that resides on the upper flue pipes and is partially burned thereon is drawn through smoke pipe 455 via the action of booster blower 421 and are thence drawn through perforated flue tubes 411, 412 and 413 where they are heated before being directed through conduit 420 upper tubes 451, 452, 453 to chimney 454. The particles and ash in the smoke pass the open ends of the flue pipes 411, 412 and 413 in conduit 421 and are directed to the ash pit at the lower end of conduit 421 via internal ramp 460.

Conduit 420 which is normally closed at its upper end by valve 450 has an intermediate extension into the combustion chamber between the lower flue tubes 411, 412 and 413 and upper tubes so that conduit 420 can be utilized as in an emergency chimney by opening valve 450 at the upper end of conduit 420 and valve 461 in the intermediate conduit 461.

The invention may provide a number of burning stations, one above the other in which the flue tubes of the invention pass to conduct the polluted gases. In this connection, the construction of FIG. 8 can be modified to provide a grate as indicated in dash lines at 470 beneath the upper tubes thereby provided a second heating and cleaning of the gases from the burning stations. Furthermore, some of the tubes 451, 452 and 453 may be apertured. In this instance, the burning from the lower stage will assist in burning the waste material in the upper area 401 of the combustion chamber and an igniter burner indicated in dash lines at 471 may also be provided in the event a two-stage burning is desired from the commencement of the burning operations. Also, a blower 472 for aiding the combustion on the upper burning station may be provided beneath grate 70 to aid in the combustion. It is understood that the position of the blower 472 is shown for illustrative purposes and that further blowers may be provided where and if required; for example, in the upper area 401 above the burning material. This is true for all of the embodiments of the invention.

As in the prior constructions, heat generated by the hot gases can be utilized in a heat exchanger thereby routing the hot gases through valve 475 below the blower 423 in exhaust conduit 454.

Figure 8A:
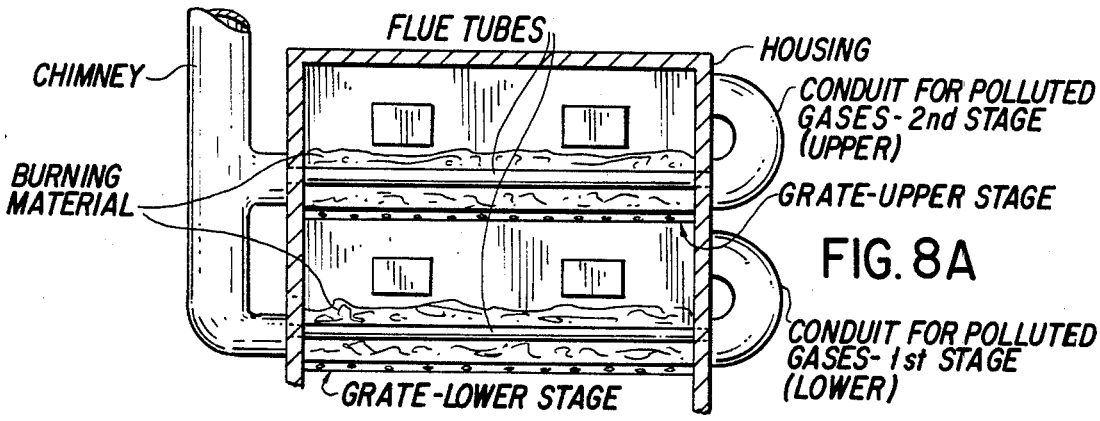
FIG. 8A is a diagramatic view of a multi-stage burning and gas purifying apparatus incorporating the invention.

FIG. 8A is a diagramatic sketch showing a lower and upper burning station in which the gases of each station from the burning material are conducted through the burning material in the respective stations and directed from each of the set of tubes in the respective stations to the chimney.

Figure 9:
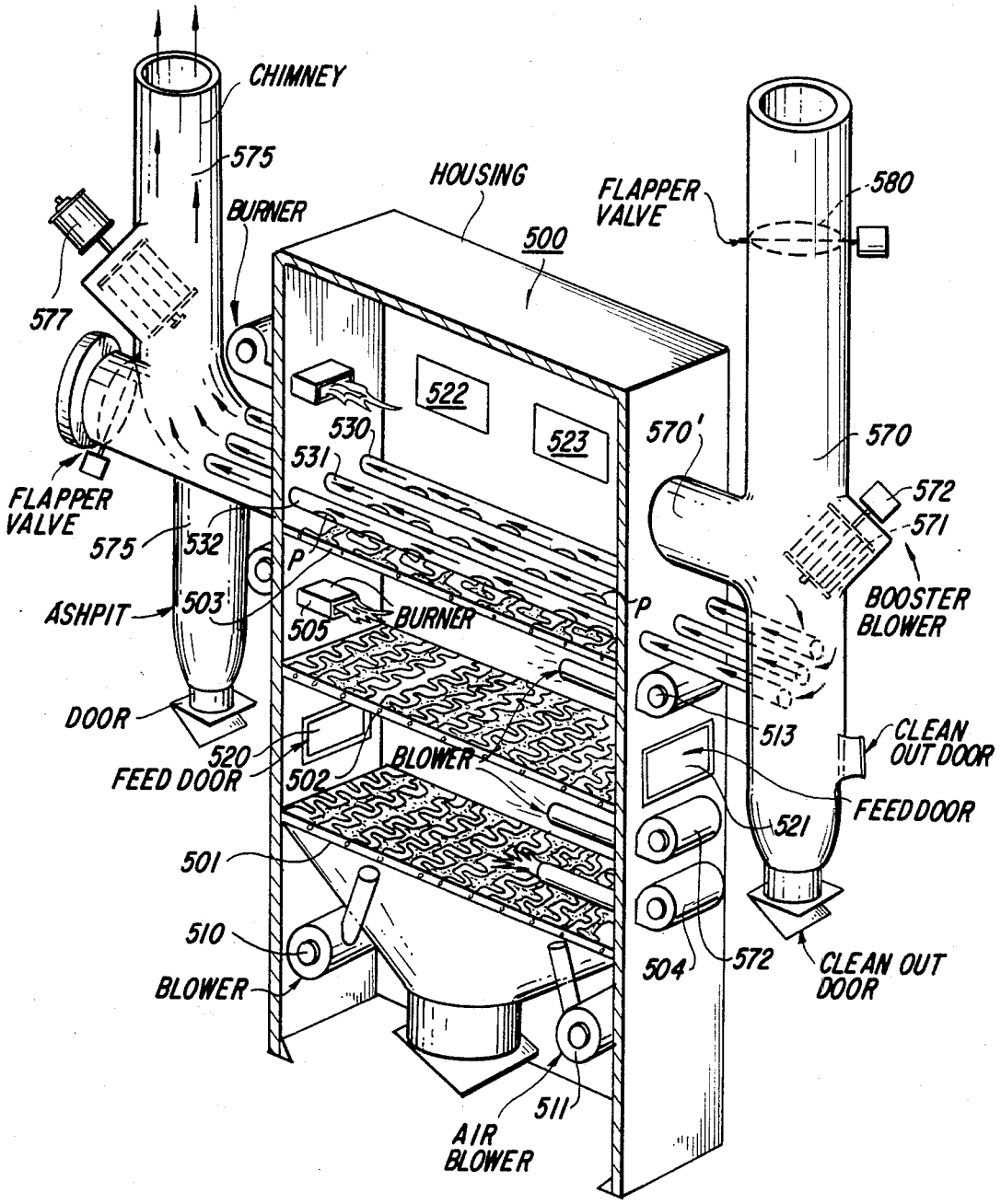
FIG. 9 is yet another perspective view, in partial schematic form, of a modification of the invention in which the horizontal tube extends through the waste material burning on an upper grate beneath which are positioned lower burning stations.

In the embodiment of the invention shown in FIG. 9, a multi-stage combustion chamber is also disclosed in which material to be burned is disposed upon lower grate 501 and on the intermediate grate 502 and an upper grate 503 supported by the walls of housing 500 of the incinerator/furnace. Igniter burners 504, 505 and 506 are provided to start the burning of the materials deposited upon the grates. Blowers 510 and 511 beneath the lower grate and blower 512 above the lower grate and below the intermediate grate and blower 513 above the intermediate grate and below the upper grate are provided to excite the burning material. Access doors are provided for each grate at 520 for the lower grate, 521 for the intermediate grate and at 522 and 523 for the upper grate. The flue tubes in this construction are disposed above the upper grate and supported by the walls of the housing and are indicated in FIG. 9 at 530, 531 and 532. These flue tubes are apertured as in the prior constructions of FIGS. 7 and 8 at P. Conduit 570 is provided at one end of the housing to receive the smoke and polluted gases from the chamber above the upper grate and flue pipes. The gases are directed through conduit 570 by blower 571 powered by motor 572 and to the open ends of the flue pipes 530, 531 and 532 where they are circulated back through the burning coke of the upper station to exit at the other open ends of the flue tubes to conduit 575. Booster blower 576 is provided to assist in directing the gases to exhaust to the atmosphere at the top of the chimney conduit 575 and is powered by motor 577. Flapper valve 578 closes the conduit 575, except when the gases are to be directed to a heat exchanger as in the construction of FIGS. 7 and 8. Valve 580 closes conduit 570 during normal operations Ash pits are provided beneath the combustion chamber and at the lower ends of conduits 570 and 575.

Burning material which may be garbage, for example, or coal or any other fuel is burned on the three vertically spaced grates and the flames, hot gases and smoke from the lower grates are drawn upwardly to the next upwardly spaced grate.

The smoke and polluted gases from all three stages are directed through extension 570' of conduit 570 through conduit 570 by blower 571 into the ends of flue tubes 530, 531 and 532 through which they pass to conduit 575. As in all prior disclosed constructions, the gases are heated to a very, very high degree because of the fact that they are passing through the bed of burning coke and the air in the gases acts to excite the burning in the inner layers of the bed of coke.

Figure 10:
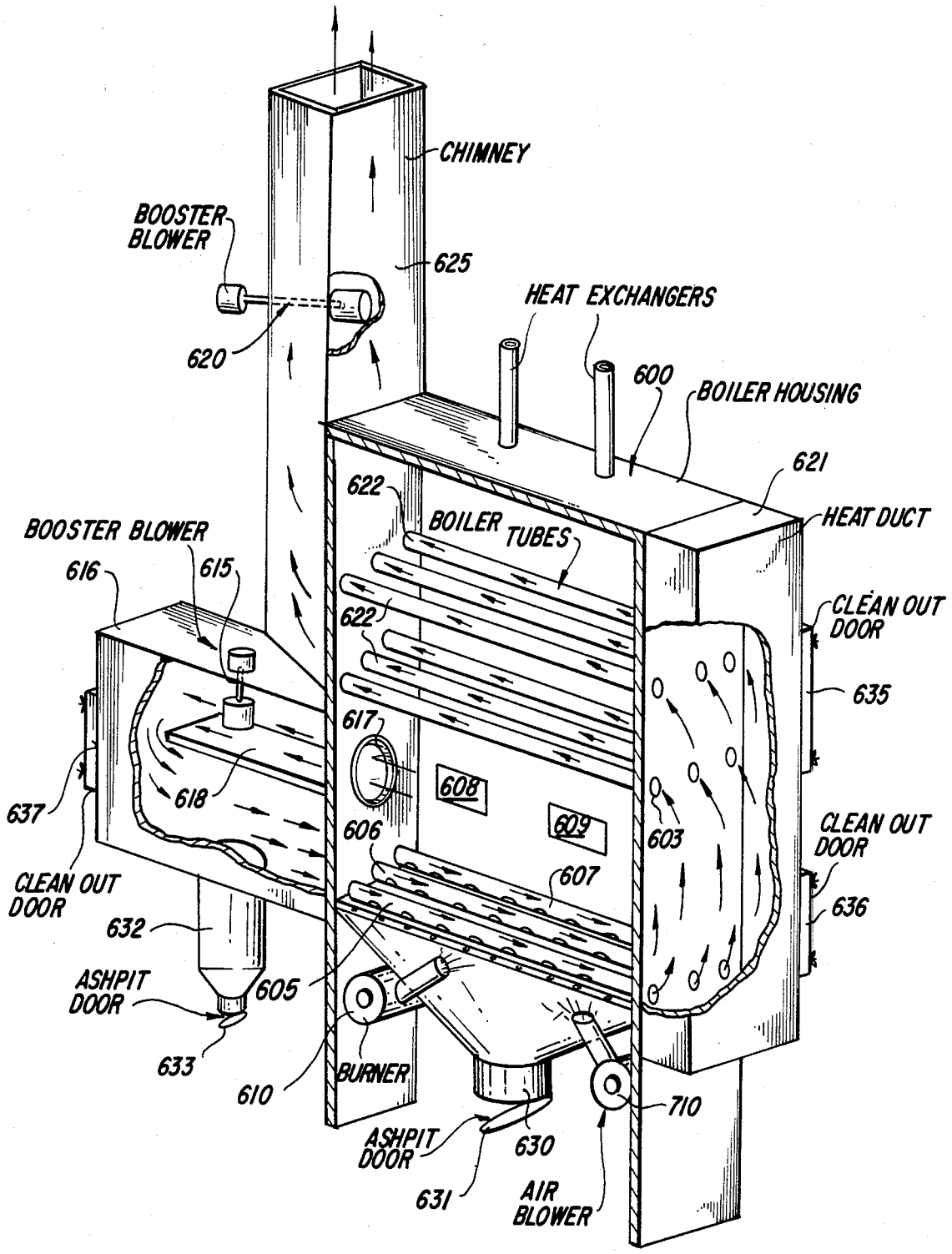
FIG. 10 is a perspective view, in partial schematic form, of the invention incorporated in an all-purpose furnace and which can be utilized, for example, for home heating.

In FIG. 10, there is disclosed a furnace 600 in which the lower section comprises a combustion chamber 601 and the upper section comprises the boiler chamber 602 separated from the combustion chamber by intermediate wall 603. While a grate 604 underlies the flue tubes 605, 606 and 607 of the invention so that fuel such as coal, wood or even waste material may be deposited thereon, having been fed through feed doors 608 and 609; the feed doors and grate would be unnecessary where the source of the heat for the furnace is an oil burner gun replacing the burner 610 which, in the present instance, is a burner for igniting the fuel which lies upon the grate and covers the tubes 605, 606, 607. In this same respect, the combustion chamber 601 would, in the instance of an oil burner furnace be lined with refractory material such as refractory bricks suggested at 611 in FIG. 10.

A blower 615 in conduit housing 616 draws the smoke and polluted gases from the burning fuel through opening 617 into the housing 616 above separator plate 618 where they are drawn, via flue action and by booster blower 620 in chimney 625, through perforated tubes 605, 606, 607, which extend through the burning fuel, then upwardly through heat duct 621 where they enter the open ends of boiler tubes 622, at the other open ends of which they exit to be passed to the atmosphere through chimney 625.

Conventional ash pits and cleaner doors 630, 631, 632, 633, are provided beneath the combustion chamber 601 and conduit housing 616, respectively.

Clean-out doors 635 and 636 are provided in the heat duct 621 for cleaning out the perforated tubes 605, 606, 607 and boiler tubes 622. A clean-out door 637 is provided at the other end of the tubes 605, 606, 607 in the conduit housing 616.

As can be appreciated, the fuel burning in the combustion chamber 601 in the instance of coal, wood or waste material and the like is ignited by burner 610 and the burning fuel is excited by air blower 710, which adds air to the burning fuel. The fuel, as in prior disclosures, rests upon the grate 605 and extends above the perforated flue tubes 605, 606, 607 so that the exhaust smoke, air and gases from the burning fuel which exit through opening 617 are conducted through the perforated tubes where they further assist in exciting the burning fuel and are further heated within the bed of burning coke to which the fuel has been reduced and so are cleansed. These gases are now "super" heated and are sufficiently hot to heat the boiler tubes to which they are drawn by the flue action of the chimney and by the booster blower 620.

Figures 11, 11A:
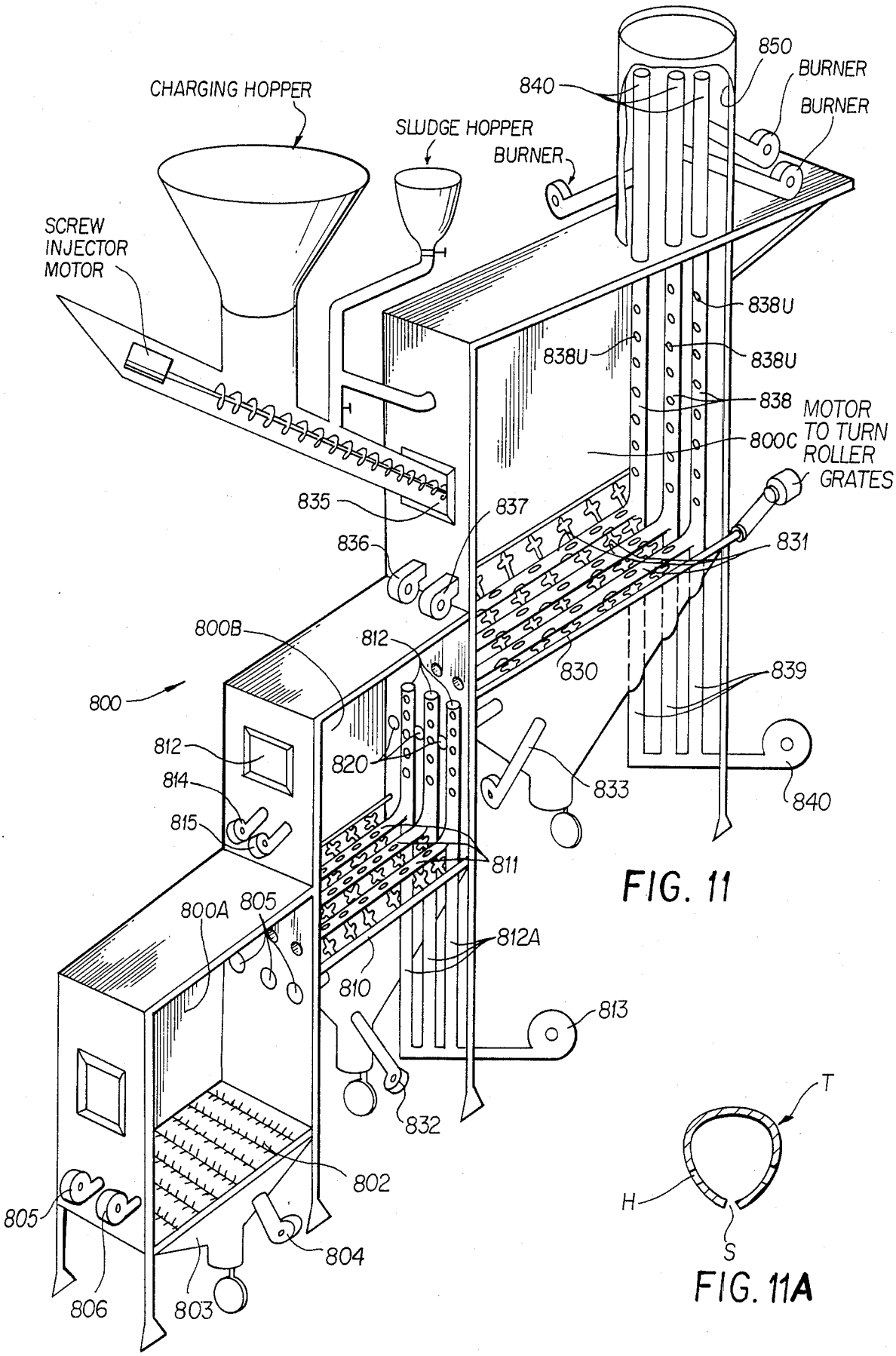
FIG. 11 is a perspective view, in partial schematic form, of an embodiment of the invention in which the exhaust gases of a series of chambers pass through horizontal and vertical conduits through the burning coke of adjacent chambers.
FIG. 11A is a diagrammatic cross section of a flue tube in accordance with the invention.

In FIG. 11, the housing 800 forms three stepped combustion combustion chambers 800A, 800B and 800C. In combustion chamber 800A, the material to be burned is deposited through access 801 upon grate 802 beneath which is collector funnel 803 where the ash is directed to a pit or the like (not shown). An air blower 804 is provided beneath the grate to excite the burning in chamber 800A and to direct the gases of combustion upwardly from the burning material. Igniter 805 and blower 806 are provided above the grate. After the material to be burned is deposited on the grate, is ignited and is burning, the polluted exhaust gases from the burning material are directed by blower 806 through flue ports 805 to beneath grate 810 in chamber 800B and through the open inlet ends of horizontal apertured tubes 811 which extend above the grate 810 and below the upper level of; i.e., through the burning material in chamber 800B which has been deposited in the chamber via access 812. The exhaust gases which pass through flue ports 805 are directed upwardly through grate 810 in chamber 800B by blower 832 beneath grate 810 and at least partially pass into the apertures of apertured tubes 811. The apertures may take the form of holes H along the lengths of the tubes T, as seen in FIG. 11A. They may also take the form of longitudinal slits S along the bottom portions of the tubes, as for example shown in the diagramatic cross section of FIG. 11A, in which the tube T is apertured both with holes H and a slit S. It is desirable to have the apertures opening below the horizontal plane of the tube axis to lessen the chances of clogging.

The apertured horizontal tubes 811 which act as flue tubes with reference to the exhaust gases from chamber 800A, communicate with apertured vertical extensions thereof 812 which extensions are also extensions from air conduits 812A, conduits 812A being supplied with air via blower 813. Igniter 814 and blower 815 are provided at one end of the chamber 800B for igniting the waste material and for directing the exhaust fumes above the burning material to flue ports 820 which extend to beneath the grate 830 in chamber 800C from whence they are directed upwardly through grate 830 by blower 833 beneath grate 830 and at least partially pass into apertured tubes 831.

The exhaust gases from the burning material, ignited by igniter 814, in chamber 800B are also directed via blower 815, through the open inlet ends of horizontal apertured tubes 831 extending above the grate 830 in chamber 800C and blow the upper level of; i.e., through the burning material in chamber 800C which has been deposited in the chamber via access 835.

Thus, the hot gases from chamber 800A are super heated in chamber 800B, both in horizontal apertured tubes 811 and in vertical apertured extension tubes 812 and these gases, along with the exhaust gases from the burning material in chamber 800B, some of which have been directed from below grate 810 through the burning material, now enter chamber 800C through the flue ports 820 beneath the grate 830 and through the open ends of horizontal apertured tubes 831 of chamber 800C. Blower 832 beneath chamber 800B and blower 833 beneath chamber 800C excite the burning in those chambers and asure that the gases from the prior lower chambers 800A and 800B which do not pass through the perforated tubes 811 and 831, are directed from beneath the grate up through the burning material where some of the gases are received in the horizontal apertured tubes 811 and 831. In chamber 800C, the burning material is deposited in the chamber upon and around the perforated tubes, as it is in chamber 800B, through access 835. Igniter 836 is provided as is blower 837.

The apertured or perforated tubes 831, as they may be called, extend through the burning material in horizontal planes and the apertured extensions 838 extend through the burning material in vertical planes. As in chamber 800B, the vertical extensions 838 are also extensions of air conduits 839 which are supplied with air by blower 840.

It is again to be noted that the burning materials extend well above the horizontal perforated tubes 811 and 831 and also cover, in large part, the apertured vertical extensions 812, 838. Under such conditions, the gases passing through the apertured tubes, which extend through the burning waste material which, as previously noted, becomes a burning coke, are super heated by the burning coke and in chamber 800C must leave the chamber via the vertical perforated extensions 838 through the upper apertures of perforated tubes 838 within chamber 800C which are above the burning material act as and are flue pipes, particularly at their uppermost portions 840 which extend out of the housing into chimney 850. The exhaust gases, because they are being heated in the flue tubes, are now so hot that they have been cleaned of impurities and actually exhaust, for the most part, as blue flames. This is also true of the gases exhausting from the vertical exensions 812 in chamber 800B.

As shown in chamber 800C in FIG. 11, and as may be supplied in all chambers and embodiments of the invention, material charging and sludge hoppers may feed a charging screw injector which feeds the material to the chamber through access 835.

Also, there is shown in FIG. 11 after burners for each exhaust flue tube within the chimney. These are fired when the temperature in the chamber(s) is below the temperature necessary for cleaning the gases, usually at start-up.

The final stage or segment of the structure of FIG. 11; that is, chamber 800C, can itself be utilized as a scrubber because of the extension of the peforated tube, both in horizontal and in vertical planes through the burning coke. In this connection, FIG. 12 discloses such apparatus standing by itself and in which chamber 900 is provided with the usual igniter and blower 901 and 902 above the burning materials and blower 903 below the burning materials. The upper level of the burning material is shown in dash lines in FIG. 12.

A grate 910 is provided below which an ash collector 912 is located for the usual function. Apertured tubes 916 may be connected with any source of polluted waste gas, for example, by extending their horizontal ends through the housing of chamber 900. In the embodiment shown, the ends of the tubes 916 are within the housing and may or may not be closed.

The material to be burned is deposited over and under the perforated pipes via access 920 and the bed of burning coke extends well above the apertured horizontal tubes. As in the construction of FIG. 11, the horizontal perforated tubes are connected at their ends and communicate with vertically extending perforated tubes 925 which extend from the tubes 926 from below the burning material and which supply air via blower 927 through the apertured vertical tubes to give direction and excitement to the now super heated exhaust gases which collect within the horizontal and vertical tubes in the burning material and now pass through the upper extensions 930 which act as and are flue tubes.

Similarly, the polluted exhaust gases rising directly from the burning material are directed via blower 902 to and through the upper apertures 925U of vertical extensions 925.

Thus, it can be seen that gases passing through the burning material in the apertured horizontal and vertical tubes are super heated and, together with the exciter air from blower 927, act to burn the gases from above the burning material entering the upper apertures of the vertical tubes above the burning material and within the chamber to clean the same before being exhaused through the flue extensions 930 in chimney 931.

Figure 12:
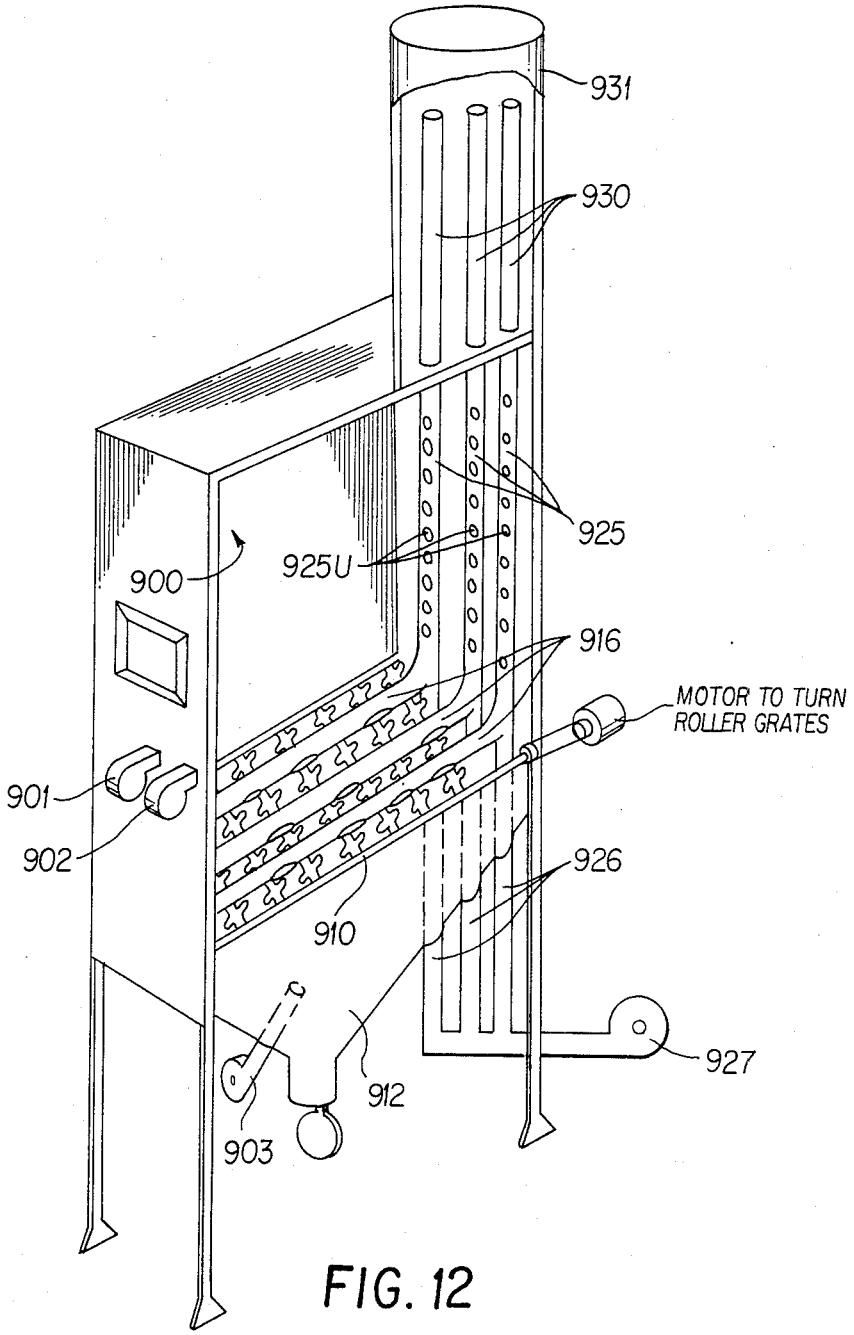
FIG. 12 is a perspective view, in partial schematic form, of an embodiment of the invention in which the combustion chamber comprises a single chamber with tubes extending therethrough in horizontal and vertical conduits which conduct gasses generated in the burning material through the burning material.

In the apparatus of FIG. 12, there is shown schematically, a motor and belt for rotating the rollers (not shown) of grate 910 for positively directing the ashes to the ash collector. Similar positive ash direction can be supplied in all embodiments of the invention.

It is understood that the foregoing is presented by way of example only and is not intended to limit the present invention except as set forth in the appended claims.

I claim:

1. Apparatus for cleaning gases within which pollutants are entrained and which gases are produced from burning material such as fuel, waste material and the like comprising:

at least one combustion chamber, the combustion area of said combustion chamber being defined by wall means for enclosing the same including a top;

means for retaining burning material in said combustion chamber up to a level below said top;

flue tube means including at least one tube extending substantially below the level to which material to be burned in said chamber is retained;

one end of said at least one tube comprising means for communication with a source of polluted gases produced by burning material;

said flue tube means intermediate its ends comprising means for conducting such polluted gases through said flue tube means within the material being burned in said combustion chamber and for directly transferring heat between the material being burned in said chamber and the polluted gases conducted through said tube means;

the other end of said flue tube means comprising means for exhausting gases conducted through said flue tube means;

said flue tube means including means for direct fluid communication between the material being burned in said chamber and the conducted gases.

2. The apparatus of claim 1, wherein said direct fluid communication means comprise aperture means in said tube means.

3. The apparatus of claim 1, wherein said at least one tube extends substantially horizontally.

4. The apparatus of claim 1, wherein said flue tube means include at least one tube extending substantially vertically.

5. The apparatus of claim 3, wherein said flue tube means include at least one tube which extends substantially vertically from said at least one horizontal tube to at least the level to which material to be burned is retained during buring in said chamber, said horizontal and vertical tubes being in fluid communication.

6. The apparatus of claim 5, wherein said at least one vertical tube includes a vertical extension extending above the level to which material is supported during burning, said vertical extension also including aperture means for communicating between said one combustion chamber above the supported burning material level; and means are provided for directing the polluted gases of combustion from said chamber through said aperture means in said vertical extension of said at least one vertical tube.

7. The apparatus of claim 6, wherein said at least one vertical tube includes a further extension extending from said combustion chamber for exhausting the gases from said chamber.

8. The apparatus of claim 5, further comprising a second combustion chamber adjacent said first mentioned combustion chamber, said second chamber being defined by wall means for enclosing the same including a top;

second means for retaining burning material in said second combustion chamber up to a level below said top of said second chamber and above the level to which the burning material is retained in said first mentioned combustion chamber;

second flue tube means including at least one tube extending substantially horizontally below the level to which material to be burned in said second combustion chamber is retained during burning;

one end of said second flue tube means extending from within said first mentioned combustion chamber above the level to which material to be burned is supported in said first mentioned combustion chamber and comprising means for communicating with the gases produced in said first mentioned combustion chamber above the level to which material to be burned in said first mentioned chamber is retained, the intermediate portion of said second flue tube means comprising means for conducting such gases therethrough within the material being burned in said second chamber and for directly transferring heat between the material being burned in said second chamber and the polluted gases conducted through said second tube means;

the other end of said second flue tube comprising means for exhausting the gases.

9. The apparatus of claim 8, wherein said fluid communication means of said second tube means comprise aperture means in said second tube means.

10. The apparatus of claim 9, wherein said second tube means include at least one tube which extends substantially vertically from said at least one horizontal tube of said second tube means to at least the level to which material to be burned in said second chamber is supported during burning, said horizontal and vertical tubes of said second tube means being in fluid communication.

11. The apparatus of claim 10, wherein said at least one vertical tube of said second tube means includes a vertical extension extending above the level to which material is supported in said second chamber during burning, said vertical extension of said second tube means also including aperture means for communicating between said second chamber above the supported burning material level; and means are provided for directing the polluted gases of combustion from said second chamber through said aperture means in said vertical extension of said at least one vertical tube of said second tube means.

12. The apparatus of claim 11, wherein said at least one vertical tube of said second tube means includes a further extension extending from said second chamber for exhausting the gases.

13. The apparatus of claim 12, wherein after burner means communicates directly into said further extension.

14. The apparatus of claim 1, wherein said means of said one end of said at least one tube for communicating with a source of polluted gases communicates with conduit means for conducting the gases and entrained pollutants produced by the burning material in said combustion chamber out of said combustion chamber, one end of said conduit means being in fluid communication with the gases and pollutants produced in said combustion chamber and extending from said combustion chamber below the top thereof and above the level to which the material is in said combustion chamber when burning, said conduit means at its other end being in fluid communication with said one end of said flue tube.

15. The apparatus of claim 14, wherein said material retaining means includes a horizontal grate for retaining the burning material below said tube means.

16. The apparatus of claim 15, wherein said flue tube means comprises a plurality of horizontal tubes, at least one of which is perforated.

17. The apparatus of claim 14, wherein further tube means are mounted within said combustion chamber above said first mentioned tube means and above the level to which the burning material is burned around said first tube means and exhaust conduit means extend from said other end of said first tube means, upwardly for fluid communication with said further tube means, said exhaust conduit means including means for directing the gases from said second tube means.

18. The apparatus of claim 17, wherein there are provided respective means positioned above said first tube means and said further tube means for feeding waste material to said first and further tube means.

19. The apparatus of claim 18, wherein second retaining means for retaining burning material below said further tube means and above the level to which burning material is burned around said first tube means and material to be burned to a second level above said further tube means, whereby the waste gases passing through said further tube means are further heated and further exhaust conducting means are provided above the second level for conducting smoke and waste gases from the burning material retained by said second retaining means.

20. The apparatus of claim 15, wherein there is provided a burning station extending in vertical spaced relation below said grate and means are provided for feeding material thereto for burning the same, whereby the heat, flames, smoke and gases from said burning station are conducted upwardly through said grate.

21. The apparatus of claim 14, wherein a boiler is arranged in close adjacency to said combustion chamber, and exhaust conduit means are provided for directing the heated and cleaned gases from the other end of said flue tube means through said boiler for heating the same.

22. The apparatus of claim 21, wherein said boiler is disposed above said combustion chamber and boiler tubes extend through said boiler and said exhaust conduit means include means for directing the heated and cleaned gases through said boiler tubes.

* * * * *